United States Patent [19]

Smith

[11] 4,384,651

[45] May 24, 1983

[54] DISPLAY ASSEMBLY

[75] Inventor: Richard A. Smith, St. Charles, Mo.

[73] Assignee: Container Corporation of America, Chicago, Ill.

[21] Appl. No.: 205,881

[22] Filed: Nov. 10, 1980

[51] Int. Cl.[3] ..... A47F 5/11

[52] U.S. Cl. ..... 211/132; 248/150; 248/174

[58] Field of Search ..... 211/132, 133, 135; 248/174, 152, 459, 460, 150, 165; 52/301; 206/45, 44

[56] References Cited

U.S. PATENT DOCUMENTS

| | | | |
|---|---|---|---|
| 1,607,177 | 11/1926 | Stevens | 248/174 |
| 2,084,635 | 6/1937 | Friedrich et al. | 206/44 R |
| 2,730,324 | 1/1956 | Taylor, Jr. | 248/459 |
| 2,940,710 | 6/1960 | Adams | 248/174 |
| 3,144,134 | 8/1964 | Frommgen | 248/174 X |
| 3,164,350 | 1/1965 | Taub | 211/133 X |
| 3,836,104 | 9/1974 | Miller et al. | 211/132 X |
| 4,274,613 | 6/1981 | Taub | 248/174 |

*Primary Examiner*—Francis K. Zugel
*Assistant Examiner*—Peter A. Aschenbrenner
*Attorney, Agent, or Firm*—Richard W. Carpenter; Davis Chin

[57] ABSTRACT

A display assembly for holding articles of merchandise therein includes a display tray attached to a collapsible support stand by means of a sling affixed to the back of the tray. The sling is slidable over the upper portion of the support stand to maintain the tray in a vertically inclined position.

5 Claims, 9 Drawing Figures

DISPLAY ASSEMBLY

BACKGROUND OF THE INVENTION

1. Field of the Invention

This invention relates generally to display assemblies which can be shipped in a collapsed condition and erected readily to a display positon. More particularly, it relates to a display assembly consisting of a display tray attached to a collapsible support stand by means of sling affixed to the back of the tray, the sling being slidable over the upper portion of the support stand.

2. Description of the Prior Art

The prior art appears to be best exemplified in the following patents which were developed in a search directed to the subject matter of this application: U.S. Pat. Nos. 1,708,792; 2,465,169; 3,164,350; 3,300,166; 3,836,104; 3,918,576 and Re. 25,309.

None of the prior art uncovered in the search disclosed a display assembly like that of the present invention which provides a display tray attached to a collapsible support stand by means of a sling affixed to the back of the tray, the sling being slidable over the upper portion of the support stand to maintain the tray in a vertically inclined position. The sling is formed with projecting tongue portions which are insertable through elongated slots in the bottom section of the tray. Tabs on inner side walls of the tray extend through openings in the tongue portions of the sling for releasably interlocking the tray and sling.

SUMMARY OF THE INVENTION

An object of the present invention is to provide a new and improved display assembly consisting of a display tray attached to a collapsible support stand by means of a sling attached to the back of the tray.

It is another object of the present invention to provide a display assembly having a tray with an integral bottom liner pad and a sling which is formed from a single blank of material that is cut, scored and can be folded for easy assembly into a completed tray-sling combination.

In accordance with these and objections, the instant invention is concerned with the provision of a display assembly comprising a collapsible support stand, a hollow angular-walled display tray, a sling and a riser panel. The sling is connected to the back of the tray and is adapted to slide over the upper portion of the support stand to maintain the tray in a vertically inclined position.

BRIEF DESCRIPTION OF THE DRAWINGS

These and other objects and advantages of the present invention will become more fully apparent from the following detailed description when read in conjunction with the accompanying drawings wherein.

DESCRIPTION OF THE PREFERRED EMBODIMENT

Figure 7:
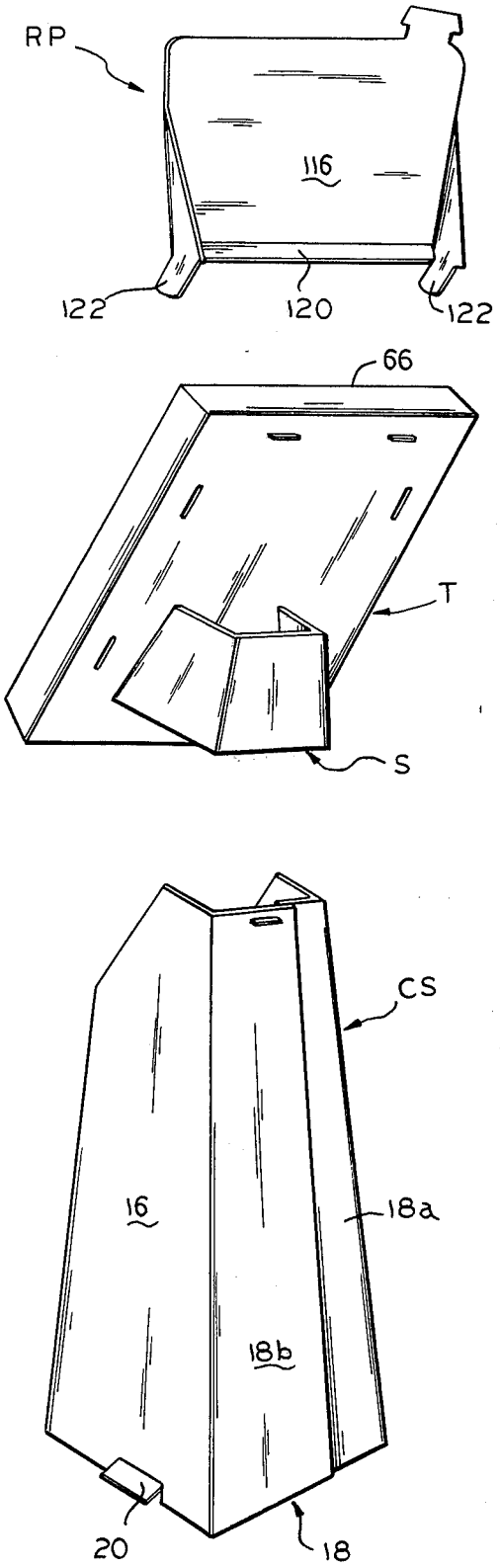
FIG. 7 is an exploded perspective view of the display assembly according to the present invention.
Figure 8:
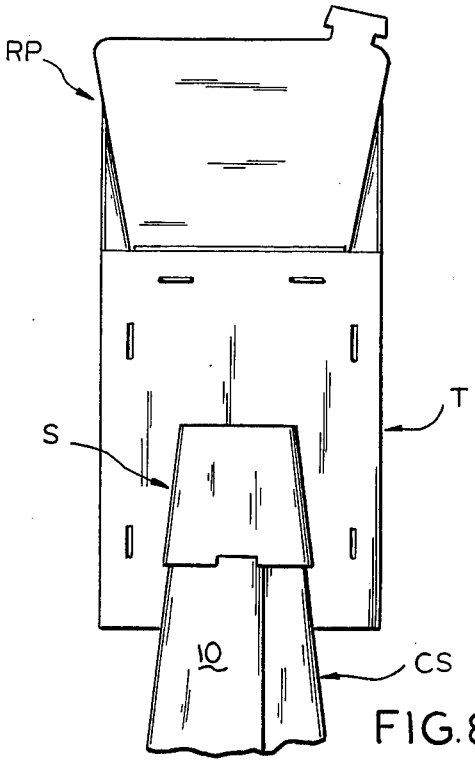
FIG. 8 is a partial back plan view of the assembled display unit.
Figure 9:
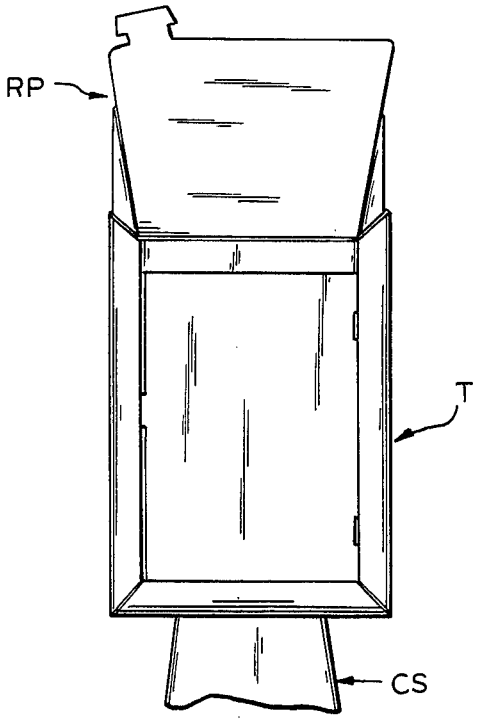
FIG. 9 is a partial front plan view of the assembled display unit.

Referring now in detail to the various views of the drawings, there is shown in FIGS. 7 and 8 the completed display assembly or unit of the present invention consisting of four basic elements which includes a collapsible support stand CS, a hollow angular-walled display tray T, a sling S, and a riser panel RP. Each of these elements is preferably constructed from a corrugated paperboard material and is cut and scored to provide quick and easy assembly for point of sale merchandising. The tray T, when assembled with the sling S, is adapted to be supported in a vertically inclined position by the sling sliding over the top of upper portion 10 of the support stand CS.

Figure 3:
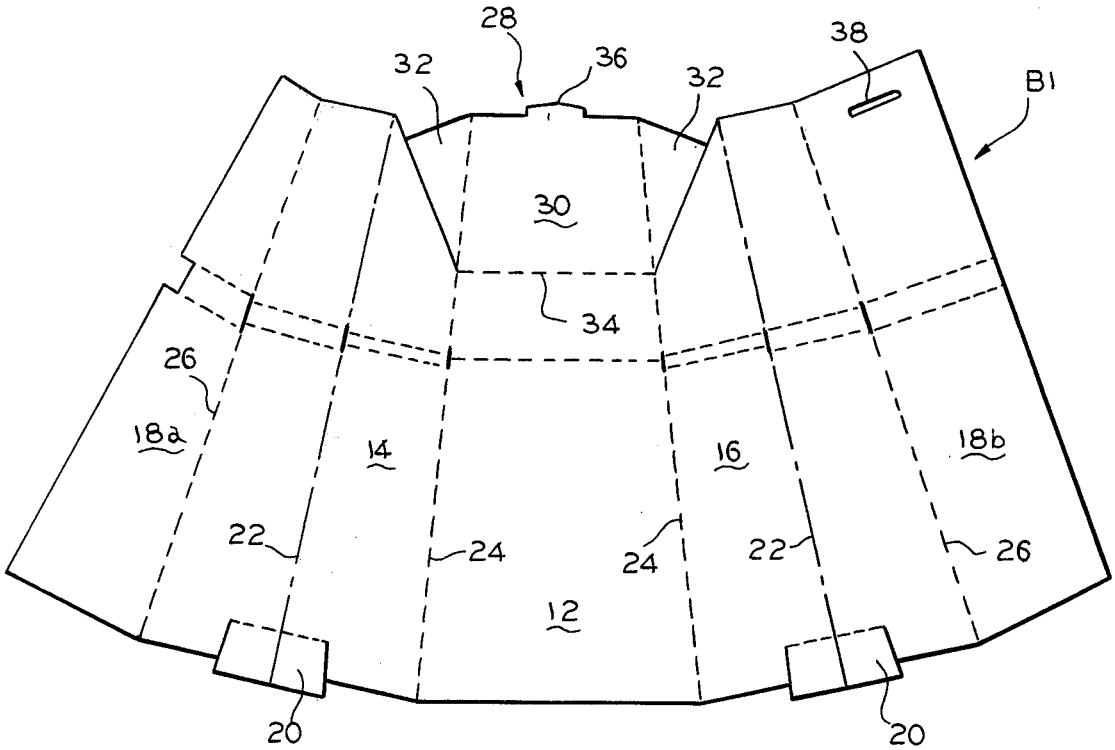
FIG. 3 is a plan view of a blank for forming the collapsible support stand of the present invention.

A blank B1 for forming the support stand CS is shown in FIG. 3 when looking onto the outward surface thereof. The blank B1 includes a front wall 12, side walls 14, 16 and rear wall portion **18*a* and 18*b*. Some or all of these walls may be suitably applied with advertising material. At its bottom end, each of the side walls 14, 16 is slit and scored to form a flap 20. When the support stand is in its erected condition, the flaps 20 are bent outwardly and act against the floor to stabilize the stand to prevent it from tipping over sideways or from sliding on the floor. The side walls are also provided with creases 22 which permit inward folding accordionwise as is conventional and are joined to the front wall 12 along fold line 24. The rear wall portions 18*a*, 18*b* are joined to the respective side walls 14, 16 along fold lines 26. In order to assemble the support stand, it is only needed to glue, staple or the like the edges of the rear wall portions 18*a* and 18*b* to form rear wall 18 of the stand (FIG. 7). An integral locking member 28 having a central panel 30 and flaps 32 is joined to the front wall 12 along fold line 34. The central panel 30 is formed with a projecting tab 36 for insertion into a slot 38 disposed in the rear wall portion 18*b***.

Figure 1:
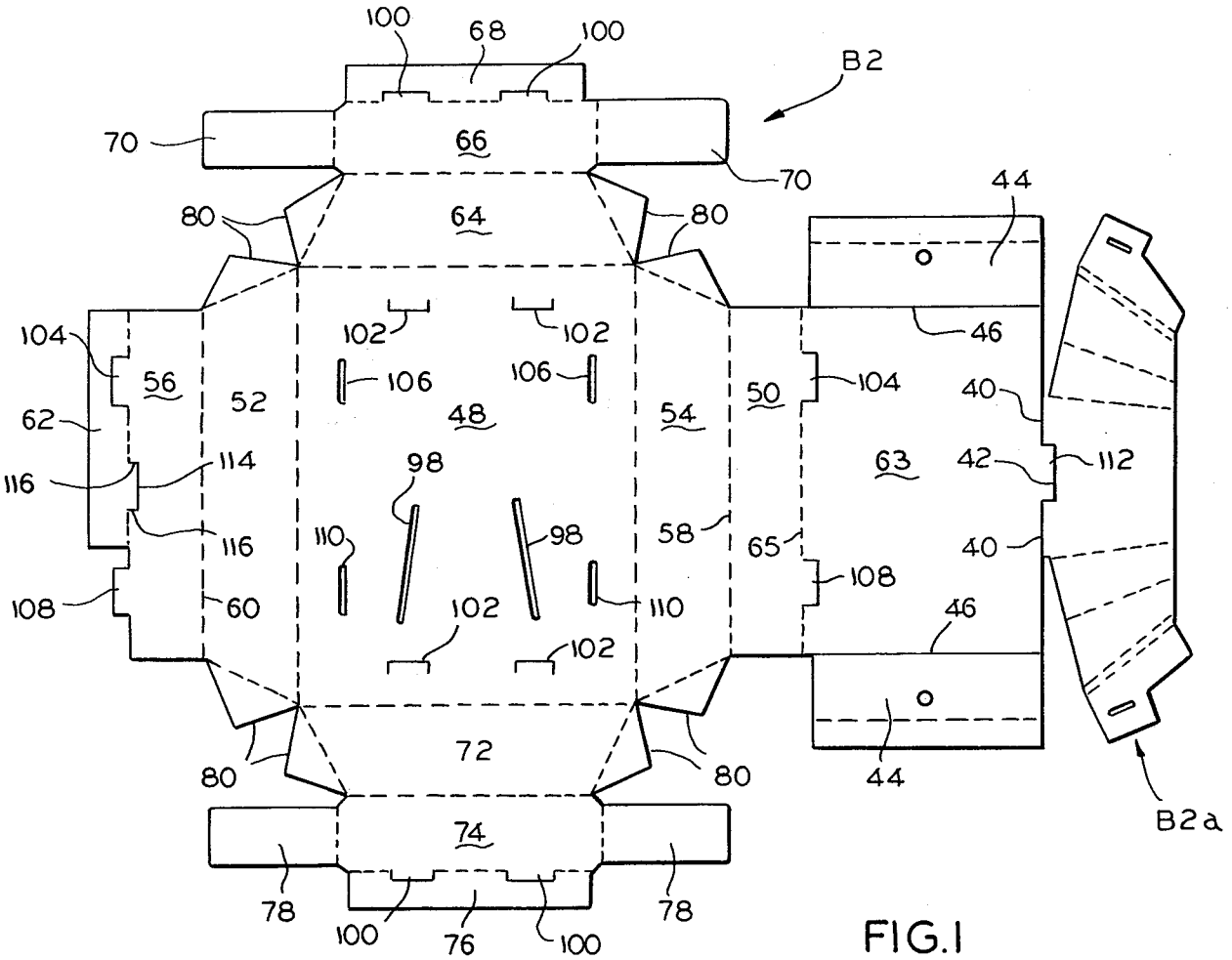
FIG. 1 is a plan view of a unitary blank for forming the display tray with an integral bottom liner pad and a sling of the present invention.

A unitary blank B2 is shown in FIG. 1 for forming the combination of the display tray with an integral bottom liner pad and a sling. The blank portion **B2*a* of the sling is initially separated from the remainder of the blank B2 via cut lines 40, 42. Panel 44 are waste material which are also cut off along lines 46 from the blank B2. The blank B2 for forming the display tray of FIG. 6 includes a generally rectangular bottom section 48 from which outer side walls 50, 52 can project upwardly. Inner side walls 54, 56 are joined to the outer side walls 50, 52 along fold lines 58, 60 respectively and are extendable downwardly toward the bottom section 48. The inner side wall 54 terminates in a foot flap 62 adapted to lie on top of the bottom section 48. The inner side wall 54 has an integral bottom liner pad 63 joined thereto along interrupted score line 65. The pad 63 is adapted to overlie adjacent the entire inner surface of the bottom section 48**.

An outer top end wall 64 projects upwardly and is joined to an inner top wall 66 extendable downwardly toward the bottom section 48. A foot flap 68 is integral with the inner top end wall 66 and is adapted to rest upon the bottom section 48. Side wall crossflaps 70 are attached to the ends of the inner top end wall 66 and are adapted to lie between the respective inner and outer side walls. Similarly, an outer bottom end wall 72 projects upwardly and is joined to an inner bottom end wall 74 extendable downwardly toward the bottom section 48. A foot flap 76 is integral with the inner bottom end wall 74 and is adapted to rest upon the bottom section 48. Side wall crossflaps 78 are attached to the ends of the inner bottom end wall 74 and are adapted to lie between the respective inner and outer side walls. The ends of the outer top end, bottom end and side walls 64, 72, 50, 52 are provided with corner flaps 80 which are adapted to fold inwardly therefrom to occupy an inclined position.

Figure 4:
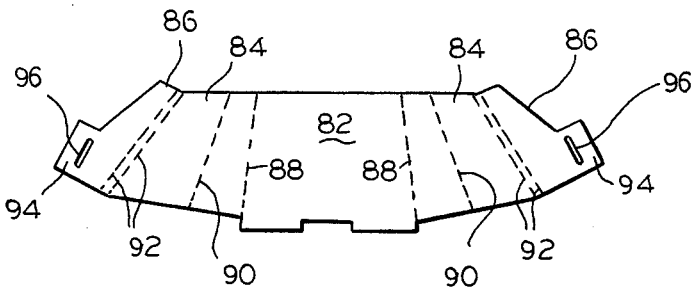
FIG. 4 is a plan view of a blank for forming the sling of the present invention.
Figure 5:
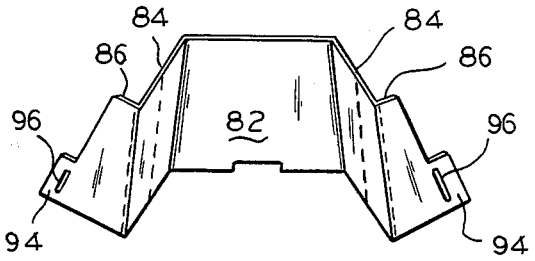
FIG. 5 shows the sling with projecting tongue portions folded outwardly.
Figure 6:
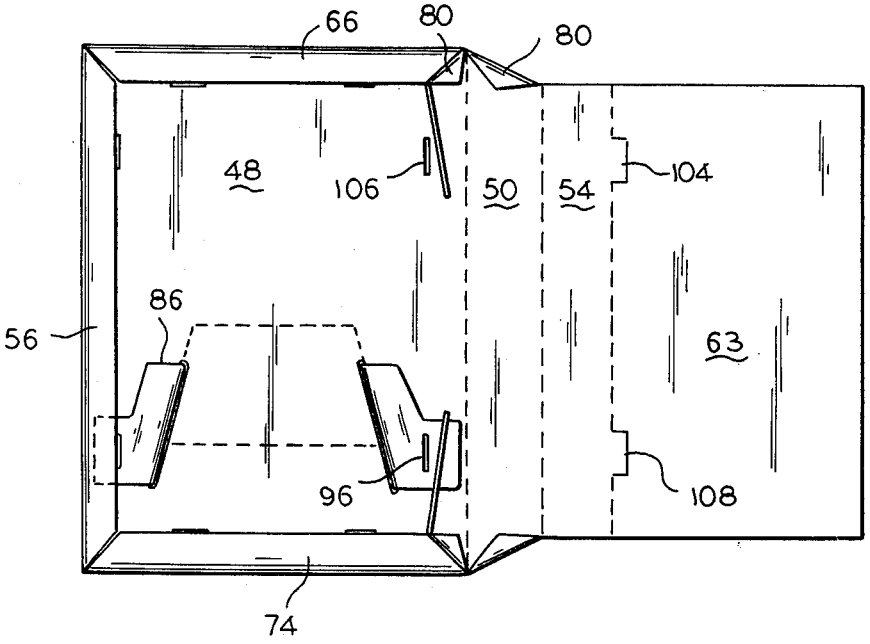
FIG. 6 shows the display tray and sling in the folded position.

Referring to FIGS. 4 and 5, the blank B2*a* for forming the sling S consists of a central panel 82, side panels 84 and end panels 86. The side panels 84 are joined to the central panel 82 along fold lines 88 and are provided with creases 90 to permit inward folding accordionwise onto the central panel. The end panels 86 are connected to the respective side panels 84 along double fold lines 92 and have projecting tongue portions 94 with openings or cuts 96 formed therein. As best seen in FIG. 6, the end panels 86 are inserted through elongated slots 98 (FIG. 1) in the bottom section 48 of the display tray and are folded outwardly to lie adjacent the bottom section 48.

To lock the outer top and bottom end walls 64 and 72 into position, tabs 100 are provided on the inner top and bottom end walls 66, 74 for insertion into U-shaped recesses 102 in the bottom section. A portion of the outer side walls 50, 52 are locked into position by means of tabs 104 which fit into slits 106. In order to interlock the display tray and sling together, tabs 108 extend through the openings 96 in the tongue portion 94 of the sling, which are aligned with recesses 110 in the bottom section, for insertion into the recesses 110. Finally, tab 112 on the liner pad 63 is interlocked into a slot formed by cut lines 114, 116.

Figure 2:
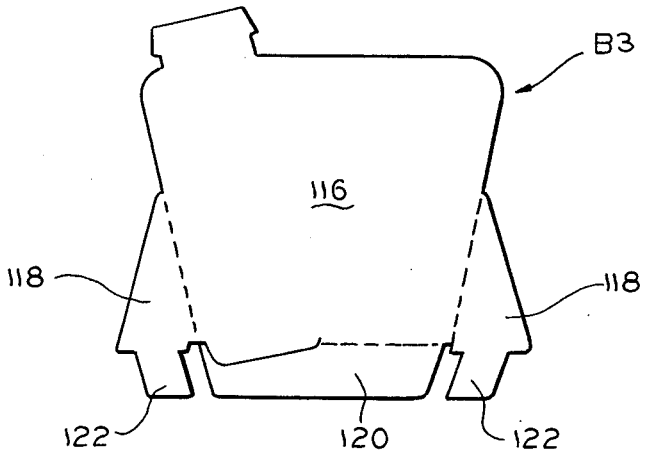
FIG. 2 is a plan view of a blank for forming the riser panel of the present invention.

In FIG. 2, there is shown a blank B3 for forming the riser panel RP which consists of a substantially rectangular central panel 116 and side panels 118. The bottom edge of the central panel 116 is joined to a ledge panel 120 which is folded upwardly and adapted to lie adjacent the outside surface of the outer top end wall 64 of the display tray. The side panels 118 are provided with projections 112 for insertion between the corner flaps 68 to maintain the riser panel in the erected condition. The riser panel typically contains advertising material.

From the foregoing detailed description, it can thus be seen that the present invention provides a new and improved display assembly consisting of a display tray attached to a collapsible support stand by means of a sling affixed to the back of the tray. The sling is adapted to telescope over the upper portion of the support stand to maintain the tray in a vertically inclined position.

While there has been illustrated and described what is at present to be a preferred embodiment of the present invention, it will be understood by those skilled in the art that there is changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out this invention, but that the invention will include all embodiments falling within the scope of the appended claims.

What is claimed is:

1. A display assembly for holding articles of merchandise therein comprising, in combination:

a collapsible support stand having front, rear and side walls to form a tapered tubular body member;

a display tray having a bottom section, outer side and end walls extending upwardly from the bottom section, and inner side and end walls extending downwardly from the outer walls toward the bottom section;

said bottom section of said display tray having elongated slots formed therein;

each of said inner side and end walls having tabs for insertion into corresponding slots formed in said bottom section to maintain said outer side and end walls in the erected condition;

a sling affixed to the outer surface of said bottom section of said tray, said sling telescoping over the upper portion of said stand to support said tray in a vertically inclined position;

said sling including a central panel, side panels joined to edges of said central panel, and end panels joined to said side panels;

each of said end panels of said sling have a projecting tongue portion with an opening therein, the tongue portion being inserted through said elongated slots formed in the tray bottom section and folded outwardly to lie adjacent the inside surface of the bottom section, the tongue portion being locked in place by said tabs on the inner side wall which extend through said openings in the tongue portions for engaging said corresponding slots in the bottom section; and a riser panel connected to and extending upwardly of one of the outer end walls of said tray, said riser panel including a substantially rectangular central panel and a pair of side panels joined to side edges of said central panel, said side panels being provided with projections for insertion into said tray to maintain the riser panel in the erected condition.

2. A display assembly as claimed in claim 1, wherein the front wall of said support stand is connected to a locking member having a central panel with a projecting tab for engaging a slot formed in the rear wall to provide an interlock between the front and rear walls.

3. A display assembly as claimed in claim 1, wherein each of the side walls of said support stand is provided with a flap in its lower edge to prevent tipping over of said stand.

4. A display assembly as claimed in claim 1, wherein a bottom liner pad is integrally connected to one edge of one of the inner side walls and is adapted to overlie adjacent said bottom section of said tray.

5. A display assembly as claimed in claim 1, wherein said corresponding slot formed in said bottom section for receiving said tabs on said inner end walls are U-shaped recesses.

* * * * *

UNITED STATES PATENT AND TRADEMARK OFFICE

CERTIFICATE OF CORRECTION

PATENT NO. : 4,384,651

DATED : May 24, 1983

INVENTOR(S) : Richard A. Smith et al

It is certified that error appears in the above-identified patent and that said Letters Patent is hereby corrected as shown below:

On the title page, insert --James P. Ambrozetes, Chesterfield, Mo. -- as a co-inventor.

Signed and Sealed this

*Twenty-third* Day of *August 1983*

[SEAL]

*Attest:*

GERALD J. MOSSINGHOFF

*Attesting Officer*

*Commissioner of Patents and Trademarks*